United States Patent [19]

Knickerbocker

[11] 4,416,398

[45] Nov. 22, 1983

[54] VARIABLE SPRAY OVERCAP AEROSOL ASSEMBLY

[75] Inventor: Michael G. Knickerbocker, McHenry, Ill.

[73] Assignee: Seaquist Valve Co., Div. of Pittway Corp., Cary, Ill.

[21] Appl. No.: 347,887

[22] Filed: Feb. 11, 1982

Related U.S. Application Data

[63] Continuation-in-part of Ser. No. 171,357, Jul. 23, 1980, Pat. No. 4,328,911.

[51] Int. Cl.[3] ..... B65D 83/14; B65D 55/12

[52] U.S. Cl. ..... 222/402.13; 222/402.17; 222/402.21

[58] Field of Search ..... 222/182, 402.13, 402.15, 222/402.17, 402.21, 402.22

[56] References Cited

U.S. PATENT DOCUMENTS

| | | | |
|---|---|---|---|
| 3,506,241 | 4/1970 | Ewald | 222/402.21 X |
| 3,795,350 | 3/1974 | Shay | 222/402.17 |
| 4,139,128 | 2/1979 | Ewald | 222/402.17 |
| 4,354,621 | 10/1982 | Knickerbocker | 222/402.22 X |
| 4,378,081 | 3/1983 | Van Lit | 222/402.21 |

*Primary Examiner*—David A. Scherbel
*Attorney, Agent, or Firm*—Frijouf, Rust & Pyle

[57] ABSTRACT

A plural spray rate aerosol assembly is disclosed for use with an aerosol container having a plural spray rate valve. The assembly comprises an actuator button having a terminal orifice connected through a valve stem to the plural spray rate valve for enabling a first discharge rate of the aerosol product from the terminal orifice upon opening the valve in a first position and for enabling a second discharge rate of the aerosol product from the terminal orifice upon opening the valve in a second position. An overcap is rotatably secured to the aerosol container and includes a finger actuator movably mounted relative to the overcap. A non-symmetrical aperture is disposed in either the actuator button or the finger actuator for cooperation with a non-symmetrical element in the other of the actuator button and the finger actuator. The non-symmetrical element is inhibited from entering the non-symmetrical aperture for transferring the finger movement of the operator to open the valve in the first position upon a first selected orientation of the finger actuator relative to the actuator button. The non-symmetrical element enters the non-symmetrical aperture for transferring the finger movement of the operator to open the valve in the second position upon a second selected orientation of the finger actuator relative to the actuator button.

18 Claims, 34 Drawing Figures

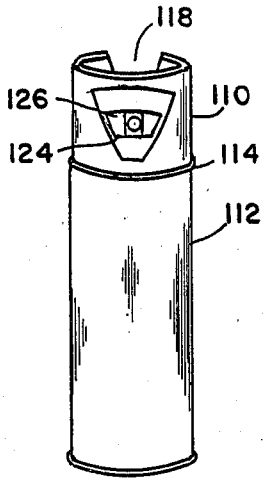
FIG. 26
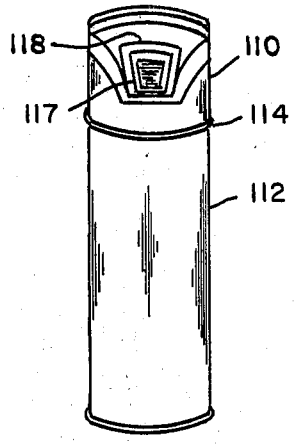
FIG. 27
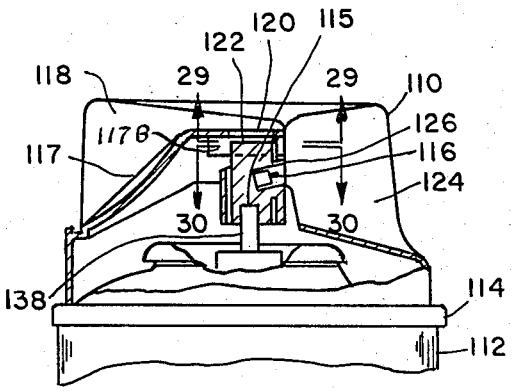
FIG. 28
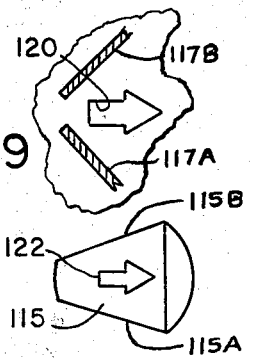
FIG. 29
FIG. 30
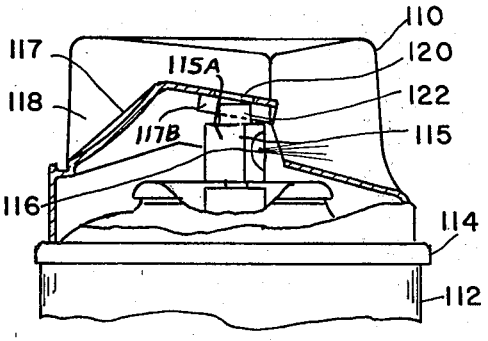
FIG. 31
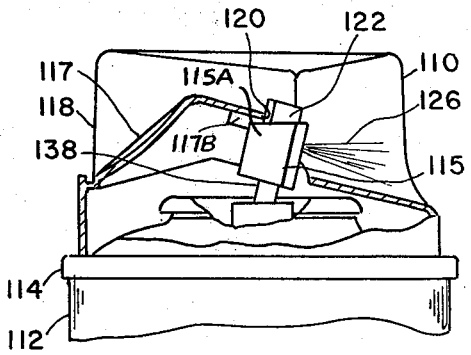
FIG. 32

VARIABLE SPRAY OVERCAP AEROSOL ASSEMBLY

CROSS-REFERENCE TO RELATED APPLICATIONS

This application is a continuation-in-part of my present pending application, Ser. No. 171,357 filed July 23, 1980 now U.S. Pat. No. 4,328,911

BACKGROUND OF THE INVENTION

1. Field of the Invention

This invention relates to aerosol products and containers and more particularly to a plural spray rate overcap assembly.

2. Description of the Prior Art

Various types of plural spray rate aerosol assemblies have been devised by the prior art. Many of the plural spray rate assemblies incorporated plural metering orifices in the valve stem to enable multiple spray rates upon the rotation of the valve stem relative to the valve body.

A novel approach to a plural spray aerosol valve assembly is disclosed in U.S. Pat. No. 3,506,241 which utilized a valve stem sealer to enable a first spray rate upon a vertical depression of the valve stem and also provided a second spray rate upon the tilting of the valve stem. An improvement of this device is disclosed in U.S. Pat. No. 4,139,128.

In my prior pending application, Ser. No. 171,357 filed July 23, 1980, I disclosed a novel child-resistant assembly utilizing a modification of the aforesaid aerosol valves with a rotatable overcap assembly.

Many of the problems of the child-resistant art are also present in the plural spray rate aerosol valve art. Accordingly, I have improved upon my prior patent application, Ser. No. 171,357, and have developed an improved plural spray rate aerosol container having many advantages over prior art plural spray rate aerosol containers.

In general, the assembly of the parts for a plural spray rate aerosol container requires a preferred orientation of the parts during the assembly process. Accordingly, it is more costly to assemble a plural spray rate assembly since the parts must be located in a preferred orientation to properly complete the assembly.

A further requirement of most plural spray rate aerosol container is the compatibility for use with conventional aerosol containers and conventional aerosol valves. With these severe restrictions and limitations, it can be appreciated by those skilled in the art that a simple and efficient plural spray rate container has not been developed by the prior art at a reasonable price.

Therefore it is an object of this invention to provide a plural spray rate assembly which overcomes the inadequacies of the prior art and provides a substantial contribution to the multiple spray rate assemblies for aerosol containers.

Another object of this invention is to provide a plural spray rate assembly for use with an aerosol container which may be assembled with the same number of component parts as a conventional aerosol container.

Another object of this invention is to provide a plural spray rate assembly for an aerosol container wherein the component parts may be assembled without concern for the orientation of the component parts.

Another object of this invention is to provide a plural spray rate assembly for an aerosol container utilizing an aerosol overcap having a finger actuator wherein the overcap is rotatably mounted on the container relative to an actuator button for enabling and first and a second spray upon a first and second selected orientation between the overcap and the actuator button.

Another object of this invention is to provide a plural spray rate assembly for an aerosol container comprising a non-symmetrical means cooperable with an aperture whereby the vertical depression and tilting of the valve may be actuated by the operator upon a selected orientation between the non-symmetrical means and the aperture.

Another object of this invention is to provide a plural spray rate assembly for aerosol containers for use with standard industry aerosol containers and valves.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purposes of summarizing the invention, the invention may be incorporated into a plural spray rate aerosol assembly for use with an aerosol container having a valve for discharging aerosol product at a first rate upon a vertical depression of the valve and for discharging aerosol product at a second rate upon tilting the valve. The invention comprises an actuator button having a terminal orifice. A valve stem connects the actuator button with the valve for discharging the aerosol product through the terminal orifice upon movement of the valve. An overcap is rotatably mounted relative to the aerosol container for at least partially covering the actuator button. A finger actuator is movably mounted relative to the overcap. Means, such as non-symmetric means, is established between the finger actuator and the actuator button for vertically depressing the valve upon operator movement of the finger actuator when the overcap is disposed in a first rotational position relative to the actuator button and for tilting the valve upon operator movement of the finger actuator when the overcap is disposed in a second rotational position relative to the actuator button.

In a more specific embodiment of the invention, a non-symmetrical aperture is disposed on one of the actuator buttons and the finger actuator for cooperation with a non-symmetrical means in the other of the actuator button and finger actuator. The non-symmetrical means is prevented from entering the non-symmetrical aperture for transferring the finger movement of the operator to vertically depress the valve upon a first selected orientation of the finger actuator relative to the actuator button. Conversely, the non-symmetrical means enters the non-symmetrical aperture to transfer the finger movement of the operator to tilt the valve upon a second selected orientation of the finger actuator relative to the actuator button.

In more specific embodiments of the invention, the finger actuator is pivotably mounted to the overcap with the pivot axis being displaced from the axis of the valve for moving the valve when the non-symmetrical means enters the aperture. The aperture may be a non-symmetrical aperture with the same distinctive shape as the non-symmetrical means enabling the non-symmetrical means to enter in only a limited number of orientations of the finger actuator relative to the actuator button. The finger actuator may be an integral member with the overcap wherein the finger actuator is pivotably mounted relative to the overcap through an integral hinge.

The plural spray rate assembly is suitable for use with both a vertical and a horizontal aerosol overcap. In the vertical aerosol overcap, the terminal orifice of the actuator button extends at least partially through the non-symmetrical aperture for discharging aerosol product through the non-symmetrical aperture. In the vertical overcap, the non-symmetrical aperture may be disposed in the finger actuator and the non-symmetrical means may comprise the outer configuration of the actuator button. In the horizontal plural spray rate assembly the overcap comprises a sidewall orifice disposed in a sidewall of the overcap with the terminal orifice of the actuator button disposed adjacent to the sidewall orifice for discharging aerosol product through the sidewall orifice in a direction substantially perpendicular to the axis of the aerosol container. In the horizontal overcap, the non-symmetrical means comprises a projection disposed on the finger actuator. It should be understood that the non-symmetrical means and the aperture may be interchanged within the structure in either the vertical or horizontal overcap.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 26 is an elevational view of the assembly incorporated into a horizontal overcap;

FIG. 27 is a rear elevational view of FIG. 26;

FIG. 28 is a side view partially in section of the horizontal overcap assembly shown in FIGS. 26 and 27;

FIG. 29 is a view along line 29—29 in FIG. 28;

FIG. 30 is a view along line 30—30 in FIG. 28;

FIG. 31 is a side view partially in section showing a vertical depression of the valve assembly in the first selected orientation; and FIG. 32 is a side view partially in section showing a tilting of the valve assembly in the second selected orientation.

Similar reference characters refer to similar parts throughout the several views of the drawings.

DETAILED DESCRIPTION

Figure 1:
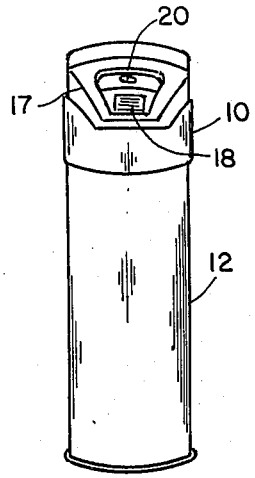
FIG. 1 is a rear elevational view of a plural spray rate aerosol assembly.
Figure 6:
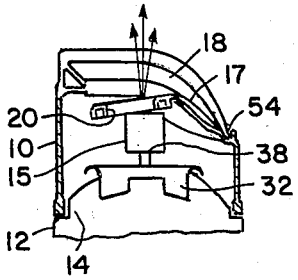
FIG. 6 is a side sectional view of FIG. 5.

FIG. 1 is a rear perspective view of the plural spray rate aerosol overcap 10 disposed on an aerosol container 12 containing a propellant and a product. In this embodiment, the overcap 10 is affixed to an upper rim 14 of the aerosol container 12 as shown in FIG. 6. The overcap 10 covers an actuator button 15 having a terminal orifice 16 shown in FIGS. 2–4 with a finger actuator 17 disposed adjacent a finger recess 18 in the overcap 10. An aperture 20 is disposed in the finger actuator 17 for enabling a vertical spray to be discharged substantially along the axis of symmetry of the aerosol container 12. It will be appreciated from the following description that the invention may be suitable for use with either a vertical overcap as shown in FIG. 1 or a horizontal overcap as shown in FIGS. 26 and 27 or other angular positions therebetween such as a forty-five degree angle spray or the like. It should also be understood that the overcap 10 may be secured to other surfaces of the aerosol container 12 including, but not limited to, the inside or outside rim of the container 12 or the inside or outside rim of the mounting cup or other means.

Figure 2:
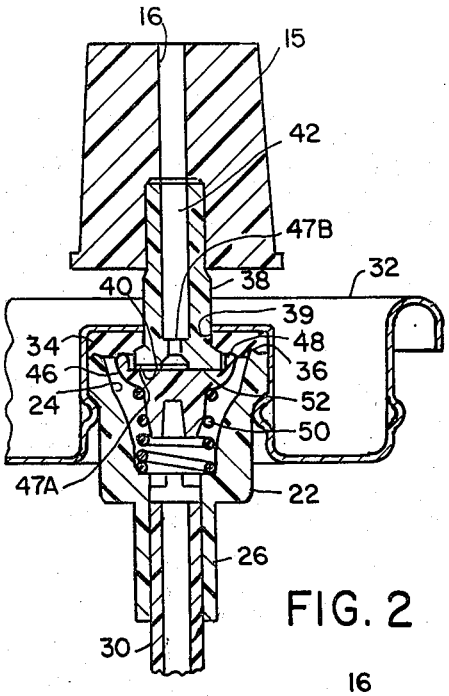
FIG. 2 is an enlarged side sectional view of a valve for use with the overcap of the assembly shown in FIG. 1 in the unattended position.
Figure 3:
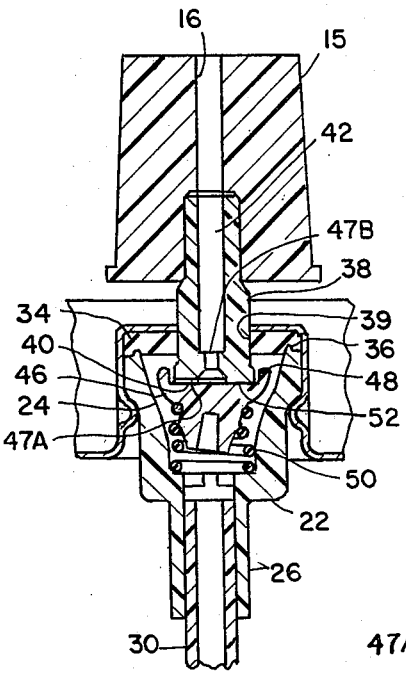
FIG. 3 is a side sectional view of the valve of FIG. 2 in the vertically depressed position.
Figure 4:
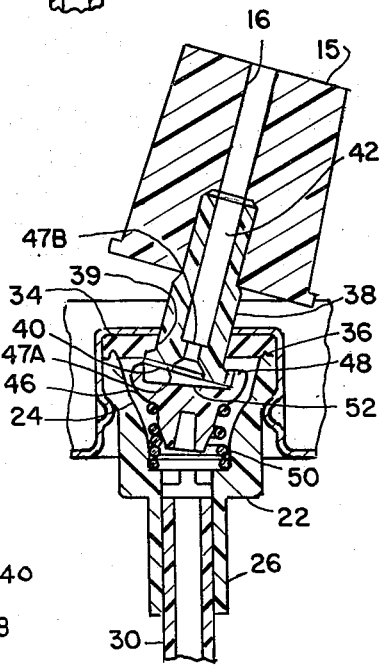
FIG. 4 is a side sectional view of the valve of FIG. 2 in the tilted position.

FIGS. 2–4 illustrate a valve assembly which is suitable for use with the invention set forth herein. The valve assembly is generally indicated as a tilt and vertical action valve and includes a valve body 22 having a body cavity 24 formed on the interior thereof. A tail portion 26 is integrally attached or otherwise connected to the valve body 22 and is attached to a dip tube 30. The dip tube 30 is disposed in fluid communication between the interior of the aerosol container 12 and the body cavity 24.

The valve body 22 is mounted to a conventional mounting cup 32 with a sealing gasket 34 disposed in sealing engagement about the upper periphery 36 of the valve body 22. A valve stem 38 having a flat base portion 40 extends through a gasket aperture 39 to allow relatively free movement of the base 40 of the valve stem 38 as will be explained in greater detail hereinafter. The stem 38 has a through aperture 42 extending between the substantially flat base 40 and the actuator button 15. The present invention is compatible with either a one-piece button and valve stem assembly or a distinct actuator button, as shown. A valve stem sealer 46 is disposed within the body cavity 24 with the upper periphery 48 of the valve stem sealer being biased by spring 50 to form a first seal with the sealing gasket 34.

Figure 3A:
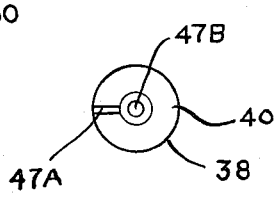
FIG. 3A is a bottom view of the valve stem of FIG. 2.

The substantially flat base portion 40 of the valve stem is supported on a substantially flat platform 52 of the valve stem sealer 46. A first metering orifice 47A shown as a slot 47A in FIG. 3A is disposed within the stem base 40 whereas a second metering orifice 47B is disposed in the stem aperture 42. This valve configuration has been disclosed in U.S. Pat. Nos. 3,506,241 and 4,243,161 which are hereby incorporated by reference. Preferably, the first and second metering apertures 47A and 47B are selected to be of different sizes to provide a first and a second flow rate as will become apparent hereinafter.

FIG. 3 illustrates a vertical depression of the valve stem 38 to disengage the upper periphery 48 of the valve stem sealer 46 from the gasket 34 to enable the product and propellant to flow around the upper periphery 48 of the valve stem sealer 46 and through the first metering orifice 47A to provide a first flow rate through stem aperture 42.

FIG. 4 illustrates the tilting of the valve stem 38 to disengage the upper periphery 48 of the valve stem sealer 46 from the sealing gasket 34 while the flat base 40 disengages with the flat platform 52. The product and propellant flows from dip tube 30 around the upper periphery 48 of the valve stem sealer 46 and through the second metering orifice 47B to provide a second flow rate through stem aperture 42.

Figure 5:
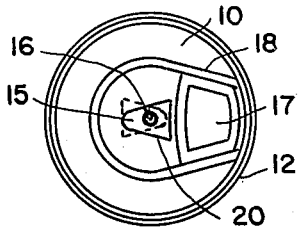
FIG. 5 is a plan view of a first embodiment of the assembly shown in a first selected orientation.

FIG. 5 is a plan view of the assembly with a side sectional view being fully shown in FIG. 6. The finger actuator 17 is pivotally mounted by a pivot 54 to the overcap 10 which overcap is rotatably mounted on the rim 14 relative to the aerosol container 12. In this embodiment, the finger actuator 17 is mounted by a hinge 54 with the pivot axis being displaced from the axis of the valve extending through stem 38 to generate a tilting motion to the valve button 15. Preferably the finger actuator 17 is an integral one-piece member with the overcap 10.

An important aspect of the present invention resides in an aperture disposed in either the actuator button or the finger actuator for cooperation with a non-symmetrical means in the other of the actuator button or the finger actuator. In FIGS. 5–8, the aperture 20 is disposed in the finger actuator 17 and the non-symmetrical means comprises the actuator button 15. In this specification, the term "non-symmetrical means" refers to a non-symmetry relative to an axis extending through the valve stem 38. In the embodiment shown in FIGS. 5–8, the actuator button 15 has the shape of an arrowhead with the aperture 20 also being a non-symmetrical aperture having an identical shape but being slightly larger than the outer configuration of the actuator button 15. The distinctively shaped non-symmetrical aperture 20 is slightly larger than the distinctively shaped non-symmetrical means of the actuator button 15 enabling the actuator button 15 to enter the aperture 20 at a skewed angle in only a limited number of selected orientations.

FIG. 5 illustrates a first selected orientation between the button 15 and the overcap 10 wherein the aperture 20 will not receive the non-symmetrical actuator button 15.

FIG. 6 illustrates the result of depressing the finger actuator 17 when the actuator button 15 and the finger actuator 17 are in the first selected orientation as shown in FIG. 5. The finger actuator 17 immediately contacts the upper surface of the non-symmetrical button 15 to vertically depress the valve stem 38. As previously explained, the product and propellant are discharged at a first rate from the aerosol container 12 as determined by the first metering orifice 47A.

Figure 7:
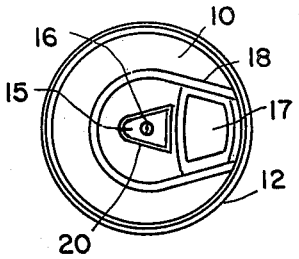
FIG. 7 is a plan view of the assembly shown in FIG. 4 with the overcap shown in a second selected orientation.

FIG. 7 illustrates a plan view of the assembly shown in FIGS. 5 and 6 in the second selected orientation of the finger actuator 17 relative to the actuator button 15. It is evident that the overcap 10 has been rotated 180 degrees relative to the container 12 to align the non-symmetrical actuator button 15 and the non-symmetrical aperture 20.

Figure 8:
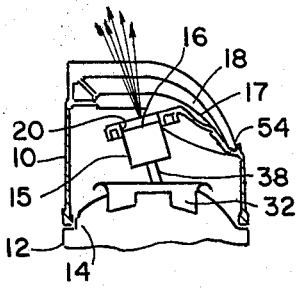
FIG. 8 is a side sectional view of FIG. 7.

FIG. 8 illustrates the result of depressing of the finger actuator 17 with the second selected orientation as shown in FIG. 7. The non-symmetrical button 15 at least partially enters the non-symmetrical aperture 20 whereby a sidewall of the aperture engages the button 15 to tilt the valve stem 38 and discharge product and propellant from the terminal orifice 16 and through the aperture 20 in accordance with the second metering orifice 47B.

It should be clear that the invention resides in part in the unique tilt valve in combination with a non-symmetrical means and a non-symmetrical aperture disposed on either the finger actuator or the actuator button. This combination enables plural discharge of product and propellant from the container depending on the selected or desired orientation between the overcap and the actuator button. Once the first embodiment of this invention is made apparent, it is clear that numerous other embodiments can be readily constructed in accordance with the basic teaching of the embodiment shown in FIGS. 1–8.

Figure 9:
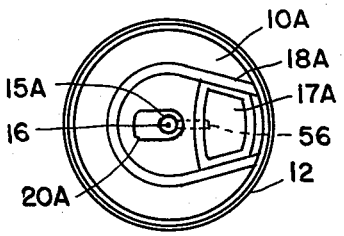
FIG. 9 is a plan view of a second embodiment of the assembly shown in a first selected orientation.
Figure 10:
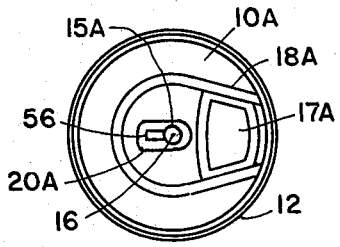
FIG. 10 is a plan view of the second embodiment shown in FIG. 9 in the second selected orientation.
Figure 9A:
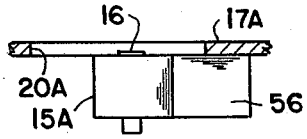
FIG. 9A is an enlarged partial side view of FIG. 9.

FIGS. 9 and 10 show a second embodiment of the assembly in the first selected and a second selected orientation, respectively. In this embodiment, the aperture 20A is an oval with the non-symmetrical means being a projection 56 extending from the actuator button 15A substantially perpendicular to the axis of the valve stem 38. FIGS. 9 and 9A show the first selected orientation wherein the projection 56 strikes the underside of the finger actuator 17A upon depression thereof as shown in FIG. 9 to vertically depress the actuator button 15. In the second selected orientation shown in FIG. 10, the actuator button 15A including the projection 56 is received within the non-symmetrical aperture 20A to enable the side of aperture 20A to engage a side of the actuator button 15A to tilt the valve in a manner similar to that shown in FIG. 8. The embodiments in FIGS. 5–10 have a single selected orientation between the actuator button and the finger actuator.

Figure 11:
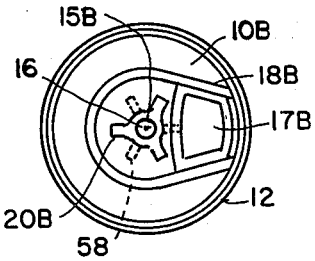
FIG. 11 is a plan view of a third embodiment of the assembly shown in the first selected orientation.
Figure 12:
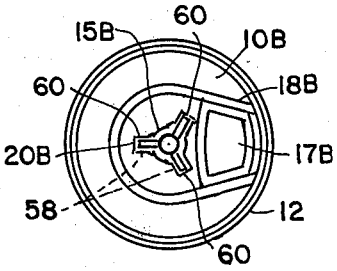
FIG. 12 is a plan view of the third embodiment shown in FIG. 11 in the selected orientation.

FIGS. 11 and 12 show a third embodiment of the assembly in the first selected and second selected orientation, respectively. The actuator button 15B has at least one projection for cooperation with a groove. In this example, a plurality of projections 58 extend substantially perpendicular to the axis of the valve stem 38. The non-symmetrical aperture 20B includes three radially spaced grooves 60 for receiving the projections upon the second selected orientation. The interrelation between the actuator button and finger actuator is identical to that heretofore described except that three selected second angular orientations exist between the overcap 10B and the actuator button 15B. It should be understood that a non-equiangular relationship may exist between the projection 58 producing a single second selected angular orientation.

Figure 13:
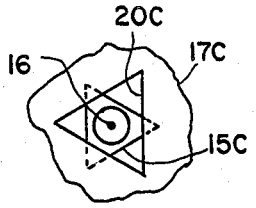
FIG. 13 is a plan view of a fourth embodiment showing the overcap in a first selected orientation.
Figure 14:
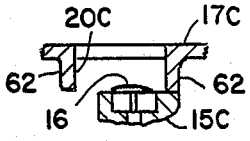
FIG. 14 is a side sectional view of FIG. 13.

FIG. 13 illustrates a fourth embodiment of the invention wherein a finger actuator 17C has a substantially triangular shaped non-symmetrical aperture 20C disposed above a substantially triangular shaped actuator button 15C. FIG. 14 is a side sectional view of FIG. 13 showing aperture 20C comprising sidewalls 62 extending downwardly from the finger actuator 17C. The substantially triangularly shaped actuator button 15C may be an isosceles or an equilateral triangle. Other variations such as stars, crosses and the like may be utilized in the practice of this invention.

Figure 15:
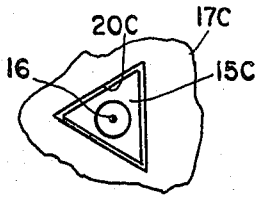
FIG. 15 is a plan view of FIG. 13 with the overcap in a second selected orientation.
Figure 16:
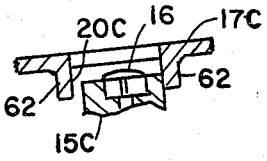
FIG. 16 is a side sectional view of FIG. 15.

FIGS. 15 and 16 show plan and side sectional views of the assemblies shown in FIGS. 13 and 14 in the second selected orientation. In FIG. 15, the triangular shaped button 15C is oriented relative to aperture 20C such that the button 15C is partially received in aperture 20C as shown in FIG. 16. It can be appreciated that actuator button 15C is not received completely through the aperture 20C but is activated by the sidewalls 62.

Figure 17:
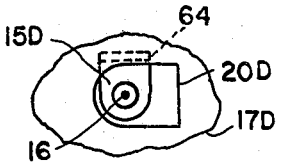
FIG. 17 is still a fifth embodiment of the invention showing the overcap in a first selected orientation.
Figure 19:
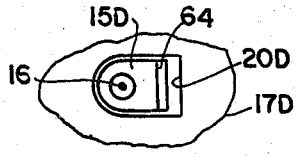
FIG. 19 is a plan view of the overcap shown in FIG. 17 in the second selected orientation.
Figure 18:
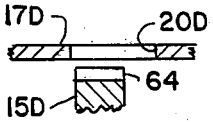
FIG. 18 is a side sectional view of FIG. 17.
Figure 20:
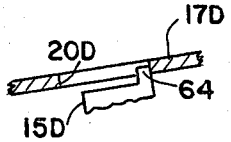
FIG. 20 is a side sectional view of FIG. 19.
Figure 21:
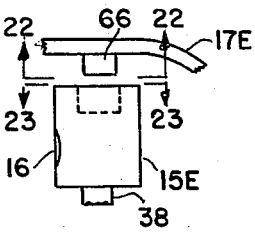
FIG. 21 is a side view of a sixth embodiment of the invention.
Figure 22:
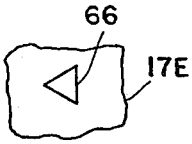
FIG. 22 is a view along line 22—22 in FIG. 21.

FIGS. 17–20 represent a fifth embodiment of the invention with the first selected orientation being shown in FIGS. 17 and 18 and the second selected orientation being shown in FIGS. 19 and 20. The non-symmetrical aperture 20D is substantially D-shaped with the actuator button 15D having a top projection 64 extending upwardly from the actuator button 15D. In the first selected position as shown in FIGS. 17 and 18, the projection 64 contacts the bottom surface of the finger actuator 17D to vertically depress the valve button 15D. In the second selected orientation, as represented by FIGS. 19 and 20, top projection 64 is engaged by the sidewall of aperture 20D to tilt the valve stem as heretofore described. This embodiment illustrates the non-symmetrical means as being a projection extending upwardly from the valve button.

A sixth embodiment of the invention is illustrated in FIGS. 21–25. In this embodiment, the aperture 20E is disposed in the valve button 15E whereas the non-symmetrical means 66 is shown more fully in FIG. 22 whereas the aperture 20E is shown more fully in FIG. 23.

Figure 23:
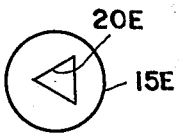
FIG. 23 is a view along line 23—23 in FIG. 21.
Figure 24:
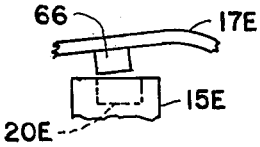
FIG. 24 shows the vertical depression of the actuator button of FIG. 21.
Figure 25:
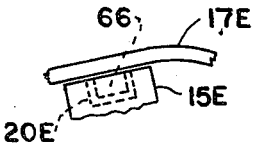
FIG. 25 shows the tilting of the actuator button of FIG. 21.

In the first selected orientation as shown in FIG. 23, movement of the finger actuator 17E causes a vertical depression of the actuator button 15E. In the second selected position, as illustrated in FIG. 25, a depression of the finger actuator 17E results in a tilting of the actuator button 15E. FIGS. 21–25 show the utilization of an aperture within the actuator button cooperating with non-symmetrical means in the finger actuator. It should be understood that the concept may be utilized in either the vertical or horizontal overcap.

FIGS. 26–32 show various views of a horizontal embodiment of the present invention. The plural spray rate assembly comprises an overcap 110 affixed to the upper rim 114 of an aerosol container 112. The overcap 110 covers an actuator button 115 having a terminal orifice 116 more clearly shown in FIG. 28. A finger actuator 117 is located in a finger recess 118 of the overcap 112. An aperture 120 is disposed in the finger actuator 117 for receiving a non-symmetrical means, shown as a projection 122, extending from the top of actuator button 115. The overcap comprises a front recess 124 having a recess orifice 126 located adjacent the terminal orifice 116 of the actuator button enabling a horizontal spray to be discharged substantially perpendicular to the axis of the aerosol container 112.

FIG. 28 is a side view partially in section of the container shown in FIGS. 26 and 27 with more specific details of the aperture 120 and the projection 122 shown more clearly in FIGS. 29 and 30. In this embodiment, the non-symmetrical aperture and the non-symmetrical means take the shape of an arrow, resulting in a single selected orientation therebetween.

The underside of the finger actuator 117 includes guide surfaces 117A and 117B projecting downwardly therefrom for contact with surfaces 115A and 115B of actuator button 115. The guide surfaces 117A and 117B insures that the overcap 110 is not rotated relative to the actuator button 115 such that the terminal orifice 116 is misaligned with the overcap recess orifice 126. The guide surfaces 117A and 117B have a greater included angle relative to the angle of surfaces 115A and 115B of actuator button 115 enabling the dual spray function of the invention but insures that the overcap is not rotated such that the terminal orifice 116 is beyond the recess orifice 126. Excessive rotation of the overcap 110 by the consumer will cause one of the surfaces 117A or 117B to rotate the actuator button in accordance with the rotation of the overcap 110.

FIG. 31 illustrates the depression of the finger actuator 117 when the actuator button is in the first selected orientation. Movement of the finger actuator 117 causes a vertical depression of the actuator button 115 resulting in a first discharge of product and propellant in accordance with the first metering orifice 47A. FIG. 32 demonstrates the tilting of the valve stem 138 and the actuator button 115 upon depression of the finger actuator 117 when the valve button 115 is in the second selected orientation relative to the overcap 110. The projection 122 is received in aperture 120 enabling the force of actuator 117 to tilt the valve button 115 to enable fluid flow at a second rate determined by second metering orifice 47B.

The foregoing has set forth a novel plural spray rate assembly which is adaptable to either a horizontal or a vertical overcap. The novel configuration resides in part in the simplicity of operation and the simplicity of the parts required to fabricate the assembly. The embodiments shown herein do not require any additional component parts from a conventional aerosol overcap assembly. Furthermore, the invention does not require any orientation of the valve button relative to the overcap assembly. Since the insertion of the valve button and the overcap assembly is generally accomplished at separate places during assembly, the lack of required orientation is extremely desirable to the aerosol industry.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, I claim:

1. A plural spray rate aerosol assembly for use with an aerosol container having a valve for discharging aerosol product at a first rate upon tilting the valve and for discharging aerosol product at a second rate upon a vertical depression of the valve, comprising in combination:

an actuator button having a terminal orifice;

a valve stem connecting said actuator button with the valve for discharging the aerosol product through said terminal orifice upon movement of the valve;

an overcap rotatably mounted relative to said aerosol container for at least partially covering said actuator button;

a finger actuator movably mounted relative to said overcap; and means established between said finger actuator and said actuator button for vertically depressing the valve upon operator movement of said finger actuator when said overcap is disposed in a first rotational position relative to said actuator button and for tilting the valve upon operator movement of said finger actuator when said overcap is disposed in a second rotational position relative to said actuator button.

2. A plural spray rate aerosol assembly for use with an aerosol container having a valve for discharging an aerosol product at a first rate upon vertical depression of the valve and for discharging the aerosol product at a second rate upon tilting the valve, comprising in combination:

an actuator button having a terminal orifice;

a valve stem connecting said actuator button with the valve for enabling discharge of the aerosol product from said terminal orifice upon movement of the valve;

an overcap secured to the aerosol container for at least partially covering said actuator button;

a finger actuator movably mounted relative to said overcap;

an aperture disposed in one of said actuator button and said finger actuator for cooperation with non-symmetrical means in the other of said actuator button and said finger actuator; and means for rotationally mounting said finger actuator relative to said actuator button for inhibiting said non-symmetrical means from entering said aperture and to transfer the finger movement of the operator to vertically depress the valve upon a first selected orientation of said finger actuator relative to said actuator button and for enabling entrance of said non-symmetrical means into said aperture to transfer the finger movement of the operator to tilt the valve upon a second selected orientation of said finger actuator relative to said actuator button.

3. A plural spray rate aerosol assembly as set forth in claim 2, wherein said finger actuator is pivotally mounted to said overcap with said pivot axis being displaced from the axis of the valve for generating a tilting motion to the valve when said non-symmetrical means enters said aperture.

4. A plural spray rate aerosol assembly as set forth in claim 2, wherein said aperture is a non-symmetrical aperture with the same distinctive shape as said non-symmetrical means enabling said non-symmetrical means to enter said non-symmetrical aperture in only a limited number of first selected orientations of said finger actuator relative to said actuator button.

5. A plural spray rate aerosol assembly as set forth in claim 4, wherein said non-symmetrical aperture is larger than said non-symmetrical means enabling said non-symmetrical means to enter said non-symmetrical aperture at a skewed angle.

6. A plural spray rate aerosol assembly as set forth in claim 2, wherein said finger actuator is an integral member with said overcap; and said finger actuator being pivotably mounted relative to said overcap through an integral hinge.

7. A plural spray rate aerosol assembly as set forth in claim 2, wherein said terminal orifice of said actuator button extends at least partially through said aperture for discharging the aerosol product through said aperture.

8. A plural spray rate aerosol assembly as set forth in claim 2, wherein said aperture is disposed in said finger actuator; and said non-symmetrical means comprising an outer configuration of said actuator button.

9. A plural spray rate aerosol assembly as set forth in claim 8, wherein said non-symmetrical means comprises the outer circumferential surface of said actuator button.

10. A plural spray rate aerosol assembly as set forth in claim 8, wherein said orifice is defined by a substantially continuous projection extending from said finger actuator for defining said aperture therein.

11. A plural spray rate aerosol assembly as set forth in claim 8, wherein said non-symmetrical means comprises a projection extending from said actuator button.

12. A plural spray rate aerosol assembly as set forth in claim 2, wherein said aperture is disposed in said actuator button; and said non-symmetrical means extends from said finger actuator.

13. A plural spray rate aerosol assembly for use with an aerosol container having a valve for discharging aerosol product at a first rate upon a tilting of the valve and for discharging aerosol product at a second rate upon a vertical depression of the valve, the improvement comprising in combination:

an actuator button having a terminal orifice;

a valve stem connecting said actuator button with the valve for discharging the aerosol product through said terminal orifice upon movement of the valve;

an overcap rotatably secured to said aerosol container for at least partially covering said actuator button;

a finger actuator pivotably mounted to said overcap with the axis of said pivot being displaced from the axis of the valve;

a non-symmetrical aperture disposed in one of said actuator button and said finger actuator for cooperation with non-symmetrical means in the other of said actuator button and said finger actuator;

said non-symmetrical means being prevented from entering said non-symmetrical aperture for transfering the finger movement of the operator to vertically depress the valve upon a first selected orientation of said finger actuator relative to said actuator button; and said non-symmetrical means entering said non-symmetrical aperture to transfer the finger movement of the operator to tilt the valve upon a second selected orientation of said finger actuator relative to said actuator button.

14. A plural spray rate aerosol assembly as set forth in claim 13, wherein said finger actuator engates an upper surface of said non-symmetrical means to vertically depress the valve upon said first selected orientation of said finger actuator relative to said actuator button; and said non-symmetrical means at least partially entering said non-symmetrical aperture enabling said non-symmetrical means to engage a sidewall of said non-symmetrical aperture to tilt said valve upon said second selected orientation of said finger actuator relative to said actuator button.

15. A plural spray rate assembly as set forth in claim 13, wherein said non-symmetrical means engages a region adjacent said non-symmetrical aperture to vertically depress said valve upon said first selected orientation of said finger actuator relative to said actuator button; and said non-symmetrical means at least partially entering said non-symmetrical aperture to tilt said valve upon said second selected orientation of said finger actuator relative to said actuator button.

16. A plural spray rate assembly as set forth in claim 13, wherein said terminal orifice of said actuator button at least partially extends through said non-symmetrical aperture for discharging the aerosol product through said non-symmetrical aperture in a direction substantially along the axis of the aerosol container.

17. A plural spray rate assembly as set forth in claim 13, wherein said overcap comprises an orifice disposed in a side wall of said overcap with said terminal orifice of said actuator button disposed adjacent said side wall orifice in a direction substantially perpendicular to the axis of the aerosol container.

18. A plural rate aerosol assembly for use with an aerosol container having a valve for discharging an aerosol product at a first rate upon movement of the valve in a first direction and a second rate upon movement of the valve in a second direction, comprising in combination:

an actuator button having a terminal orifice;

a valve stem connecting said actuator button with the valve for enabling discharge of the aerosol product from said terminal orifice upon movement of the valve;

an overcap rotatably secured to the aerosol container for at least partially covering said actuator button;

a finger actuator movably mounted relative to said overcap; and means established between said finger actuator and said actuator button for enabling said finger actuator to move the valve in the first direction upon a first rotational position of said overcap and for enabling said finger actuator to move the valve in the second direction upon a second rotational position of said overcap.

* * * * *

UNITED STATES PATENT AND TRADEMARK OFFICE

CERTIFICATE OF CORRECTION

PATENT NO. : 4,416,398

DATED : November 22, 1983

INVENTOR(S) : Knickerbocker, Michael G.

It is certified that error appears in the above-identified patent and that said Letters Patent are hereby corrected as shown below:

In the Abstract

Column 1, Line 29, delete "4,234,128" and insert therein --4,243,161--.

Column 8, Line 21, delete "112" and insert --110--.

Signed and Sealed this

*Fifteenth* Day of *October 1985*

[SEAL]

*Attest:*

DONALD J. QUIGG

*Attesting Officer*

*Commissioner of Patents and Trademarks—Designate*